US007034690B2

(12) United States Patent
Chaco

(10) Patent No.: US 7,034,690 B2
(45) Date of Patent: Apr. 25, 2006

(54) INFANT MONITORING SYSTEM AND METHOD

(75) Inventor: John Chaco, Seymour, CT (US)

(73) Assignee: Hill-Rom Services, Inc., Wilmington, DE (US)

( * ) Notice: Subject to any disclaimer, the term of this patent is extended or adjusted under 35 U.S.C. 154(b) by 457 days.

(21) Appl. No.: 09/960,429

(22) Filed: Sep. 21, 2001

(65) Prior Publication Data

US 2002/0084903 A1 Jul. 4, 2002

Related U.S. Application Data

(63) Continuation of application No. 09/500,204, filed on Feb. 8, 2000, now abandoned.
(60) Provisional application No. 60/119,268, filed on Feb. 9, 1999.

(51) Int. Cl.
*G08B 23/00* (2006.01)

(52) U.S. Cl. ..... 340/573.1; 340/539.1; 340/539.11; 340/539.12; 340/539.13; 340/539.15; 340/539.21; 340/573.4

(58) Field of Classification Search ..... 340/573.1, 340/539.11, 539.13, 539.15, 539.21, 539.12, 340/573.4
See application file for complete search history.

(56) References Cited

U.S. PATENT DOCUMENTS

| | | | | |
|---|---|---|---|---|
| 4,279,433 A | | 7/1981 | Petaja | |
| 4,495,495 A | | 1/1985 | Ormanns et al. | |
| 4,495,496 A | | 1/1985 | Miller, III | |
| 4,593,273 A | | 6/1986 | Narcisse | |
| 4,814,751 A | | 3/1989 | Hawkins et al. | |
| 4,833,452 A | | 5/1989 | Currier | |
| 4,853,692 A | * | 8/1989 | Wolk et al. | 340/573.1 |
| 4,899,135 A | | 2/1990 | Ghahariiran | |
| 5,006,830 A | | 4/1991 | Merritt | |
| 5,062,151 A | | 10/1991 | Shipley | |
| 5,086,290 A | | 2/1992 | Murray et al. | |
| 5,266,944 A | | 11/1993 | Carroll et al. | |
| 5,291,399 A | | 3/1994 | Chaco | |
| 5,357,254 A | | 10/1994 | Kah, Jr. | |
| 5,396,224 A | | 3/1995 | Dukes et al. | |
| 5,396,227 A | * | 3/1995 | Carroll et al. | 340/573.1 |
| 5,455,560 A | | 10/1995 | Owen | |
| 5,455,851 A | | 10/1995 | Chaco et al. | |
| 5,461,390 A | | 10/1995 | Hoshen | |
| 5,465,082 A | | 11/1995 | Chaco | |
| 5,475,367 A | | 12/1995 | Prevost | |
| 5,515,426 A | | 5/1996 | Yacenda et al. | |
| 5,548,637 A | | 8/1996 | Heller et al. | |
| 5,568,119 A | | 10/1996 | Schipper et al. | |
| 5,588,005 A | | 12/1996 | Ali et al. | |
| 5,594,786 A | | 1/1997 | Chaco et al. | |
| 5,621,388 A | | 4/1997 | Sherburne et al. | |
| 5,635,907 A | | 6/1997 | Bernard et al. | |
| 5,636,245 A | | 6/1997 | Ernst et al. | |
| 5,650,769 A | | 7/1997 | Campana, Jr. | |
| 5,650,770 A | | 7/1997 | Schlager et al. | |
| 5,682,139 A | | 10/1997 | Pradeep et al. | |
| 5,686,888 A | | 11/1997 | Welles, II et al. | |

(Continued)

*Primary Examiner*—Daryl C. Pope
(74) *Attorney, Agent, or Firm*—Bose McKinney & Evans LLP

(57) ABSTRACT

A system and a method for monitoring objects including infants. The system and method having a first transmitter attached to the object to be monitored, the first transmitter transmits an ID corresponding to the first transmitter. A transceiver associates transmitters by storing in memory IDs of respective transmitters. The transceiver receives the ID corresponding to the first transmitter and compares the received ID with the stored IDs. An alarm is activated upon failure of a preset condition based on signals received by the transceiver.

23 Claims, 11 Drawing Sheets

U.S. PATENT DOCUMENTS 5,686,902 A 11/1997 Reis et al.
5,689,229 A 11/1997 Chaco et al.
5,691,980 A 11/1997 Welles, II et al.
5,705,980 A 1/1998 Shapiro
5,708,421 A 1/1998 Boyd
5,731,757 A 3/1998 Layson, Jr.
5,751,246 A 5/1998 Hertel
5,760,704 A 6/1998 Barton et al.
5,793,290 A 8/1998 Eagleson et al.
5,808,564 A 9/1998 Simms et al.
5,812,056 A 9/1998 Law
5,822,544 A 10/1998 Chaco et al.
6,104,295 A * 8/2000 Gaisser et al. ..... 340/573.4
6,211,790 B1 * 4/2001 Radomsky et al. ..... 340/573.4
6,259,355 B1 7/2001 Chaco et al.

* cited by examiner

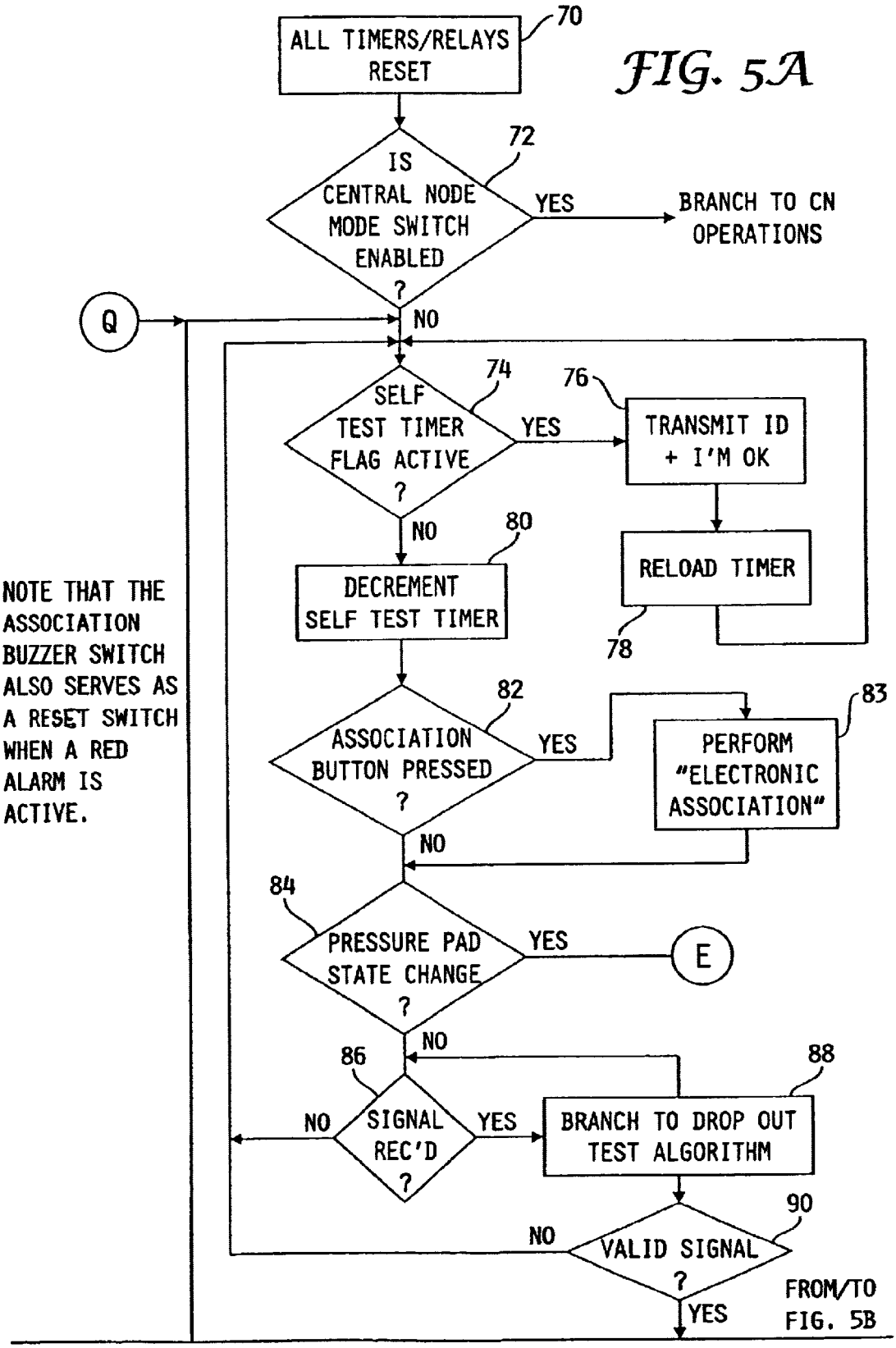
FIG. 5A
ALL TIMERS/RELAYS RESET
70
IS CENTRAL NODE MODE SWITCH ENABLED ?
72
YES
BRANCH TO CN OPERATIONS
Q
NO
SELF TEST TIMER FLAG ACTIVE ?
74
YES
76
TRANSMIT ID + I'M OK
RELOAD TIMER
78
NO
80
DECREMENT SELF TEST TIMER
NOTE THAT THE ASSOCIATION BUZZER SWITCH ALSO SERVES AS A RESET SWITCH WHEN A RED ALARM IS ACTIVE.
ASSOCIATION BUTTON PRESSED ?
82
YES
PERFORM "ELECTRONIC ASSOCIATION"
83
NO
PRESSURE PAD STATE CHANGE ?
84
YES
E
NO
SIGNAL REC'D ?
86
NO
YES
BRANCH TO DROP OUT TEST ALGORITHM
88
VALID SIGNAL ?
90
NO
YES
FROM/TO FIG. 5B

FROM/TO FIG. 5A

92
IS BM NORMAL MODE OR FLAGS ?
FLAG PATH
NORMAL PATH
94
BABY WITHIN 30 FT.?
NO
DISTANCES ARE PROGRAMMABLE
YES
96
BABY WITHIN 15 FT.?
NO
YES
98
CARE GIVER/MOM WITHIN X FT.?
NO
OPTIONAL PATH
YES
A
B
100
NEW INSTRUCTIONS FROM CENTRAL NODE ?
YES
BRANCH TO NEW INSTRUCTIONS
NO
RED ALARM
YES
102
NO
YELLOW ALARM
YES
A
104
NO

INFANT MONITORING SYSTEM AND METHOD

This application is a continuation of U.S. patent aplication Ser. No. 09/500,204, filed Feb. 8, 2000, now abandoned, which claims the benefit of U.S. Provisional Patent Application Ser. No. 60/119,268, which was filed on Feb. 9, 1999.

BACKGROUND OF THE INVENTION

1. Field of the Invention

This invention generally relates to a system and method for monitoring personnel; particularly, a personnel monitoring system and method having applications in institutions such as hospitals, homes, and penal institutions for ensuring the security of infants and monitoring the movement of children, patients, and prisoners.

2. Discussion of the Related Art

Monitoring systems are available in which, for example, tags are attached to articles. If the tag and article are moved past a detector placed at a strategic location such as an exit, an alarm sounds. Such shop-lifting prevention systems are widely used in department stores. In many cases, it is desirable to monitor movement of persons and in particular to instantly detect the identity of such persons when such movement is detected. In the particular case of hospitals and penal institutions, it is desirable to monitor movement of individuals from one area to another in the building, or at entrances and exits to the building.

In these cases it is not enough to simply detect movement. It is essential to be able to detect both that movement has taken place, and it is also necessary to immediately identify the person detected.

For example in the case of a hospital maternity ward, where despite close monitoring, the number of infant theft attempts has been on the increase. Infant mixups or swaps have also been recent news items.

The movement, location at any point in time, and identity of individuals in such settings is of paramount importance to those responsible for the safety and well being of the young, infirmed, and incarcerated.

In the particular case of infants or patients in hospitals it is important not only to detect movement from one area to another, but it may also be necessary to institute some form of remedial action such as initiating an alarm or instituting a search when unwarranted movement is detected.

SUMMARY OF THE INVENTION

The present invention, in the most general sense, is a personnel monitoring system for locating and identifying individuals within a facility. More specifically, in accordance with a preferred embodiment, the present invention is directed to a child security system for monitoring an infant in a maternity ward setting.

A preferred system of the present invention includes a locator subsystem and a security subsystem. The locator subsystem is capable of determining locations of badges. The security subsystem is capable of monitoring badges and activating alarms upon detection of security breach conditions. It is contemplated that the badges will be worn by infants and designated personnel associated with the infant (e.g., mother, father, nurse, visitors). A plurality of transceiver modules provide monitoring and location functions. A transceiver module (TM) is preferably mounted at the bassinet and another is mounted on a wall in the nursing room.

The TM is capable of receiving and storing signal data including ID signals being substantially continuously transmitted from the infant and adult badges. The transceiver also includes a processor for processing the data (signal strength) from the badges. From the received data the TM processor computes range data for those badges and infant anklet that are within range. The received ID is compared with a stored local "association" database and together with the range information is used to ensure that one of the designated individuals is near the infant (i.e. a non-alarm condition defined by at least one designated person within a predefined, programmable, zone of safety around the infant). Badge identification and range determination is achieved using one or both of the wireless IR and RF data link from the adult badges and infant (anklet) to the TM. The two links are considered mutually redundant.

In one aspect of the invention, a method of monitoring one or more infants comprises the steps of: an infant transmitter for substantially continuous transmission of an infant identification signal, said first transmitter being securably attached to an infant to be monitored; a plurality of mobile transceivers to be worn by individuals responsible for the safety of said infant, each of said plurality of badges including a transceiver transmitting a substantially continuous unique identification signal. The system includes a transceiver module comprising: a receiver for detecting the infant identification signal from the infant transmitter and the unique identification signals from the plurality of mobile transceiver; a transmitter for transmitting signals to said plurality of mobile transceivers; and a processor for determining the range of the mobile transceivers, said processor also for generating alarm condition signals.

Since operation is based upon proximity detection and low cost repeaters, the method of the present invention can be effectively employed, for example, at attraction theme parks, children's hospitals, old age homes, and similarly situated venues where personnel detection is at issue. Further, if a wider area of coverage is desired, additional transceiver working in unison (i.e. WEB architecture), could detect that at least one of several networked transceivers is in touch with a particular anklet.

These and other objects, features and advantages of the present invention will become apparent from the following detailed description or illustrative embodiments thereof, which is to be read in connection with the accompanying drawings.

FIGS. 5A and 5B are flowchart illustrating an embodiment of a method of personnel monitoring according to the present invention.

DETAILED DESCRIPTION OF PREFERRED EMBODIMENTS

Figure 1:
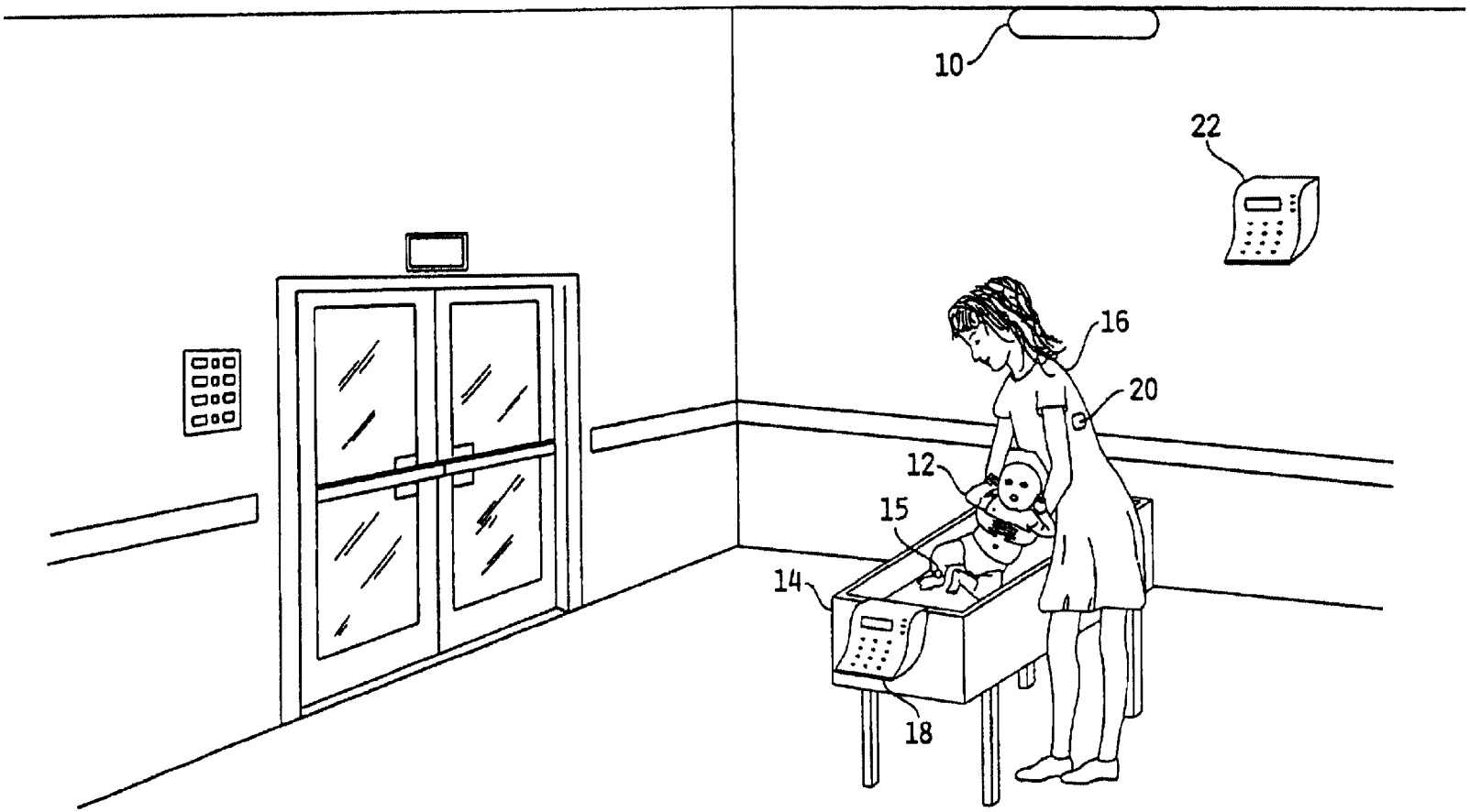
FIG. 1 is a perspective view of a typical hospital nursery environment with an infant depicted with a portion of a system of the present invention.

FIG. 1 illustrates an exemplary use of a personnel monitoring system of the present invention. There is shown at FIG. 1 a typical nursery 10 environment as known in hospitals or infant care rooms in which an infant 12 is placed in a bassinet 14. The infant 12 is wearing an infant badge 15, which can be in the form of a bracelet, anklet, or a skin contact badge and is tended to by a nurse or care giver 16 wearing an adult badge 20. It is further contemplated that other persons affiliated with the infant (e.g., mother, father, visitors) would also be assigned badges. Also illustrated in FIG. 1 is a transceiver module (TM) 18, which in this case is shown mounted on the bassinet 14. Upon association of the infant and adult badges to the bassinet TM, the bassinet system constitute the basic components of a monitoring system for a single infant, as will be further described below.

A wall mount TM 22 is electronically linked to the bassinet TM 18 and a ceiling unit 10, which is in turn electronically linked to a central server of a locator system.

Figure 2A:
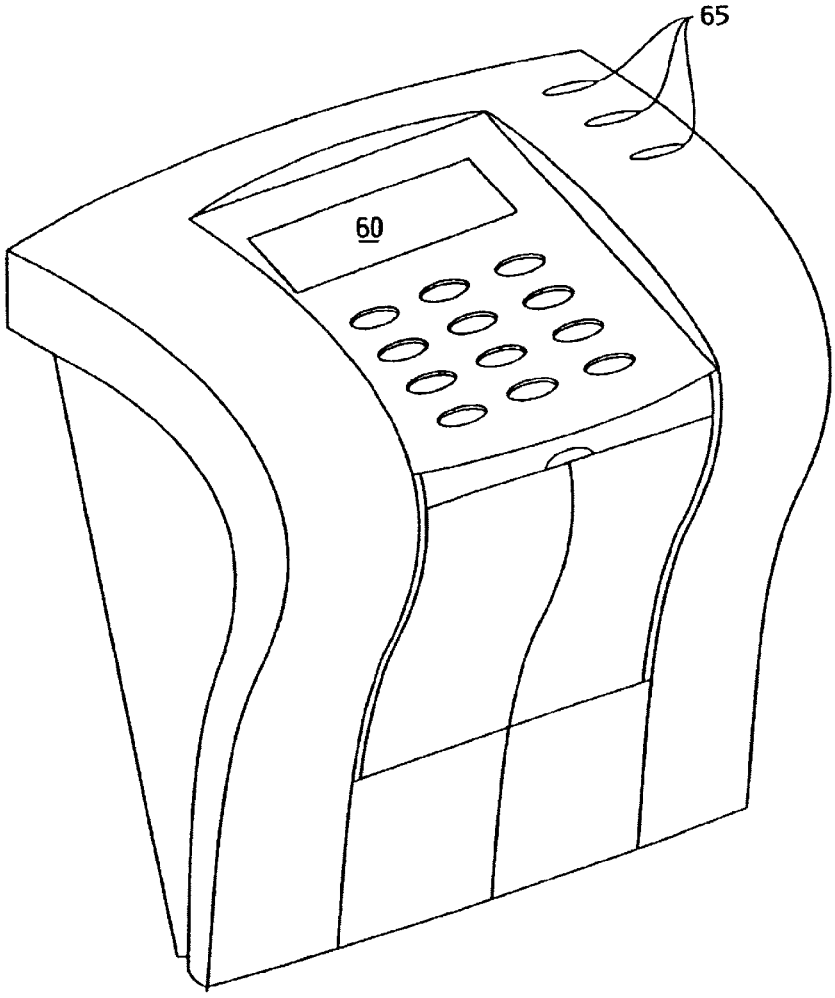
FIG. 2A is a perspective view of a transceiver module assembly of a preferred embodiment of the present invention.

As shown in FIG. 2A, the transceiver module housing exterior preferably includes red, green and yellow LED indicators 65 preferably located on the top of the transceiver housing that are software settable and serve to identify the operating status of the TM, for example, red alert, yellow alert or normal operation. A display 60 and a keypad facilitate interface with the TM processor, including data entry and password control. The keypad is preferably of a 12 key telephone type. As will be explained below, the keypad can also be used by the nurse to locate a wandering mom. In this case, the TM will receive the location information based on the information received from the infrared badge worn by the mother. The display would report the location of the mother. Also the keyboard can be used to reset alarms originated from the TM. Alarm conditions are transmitted to other TMs. When an alarm is received, the receiving station will report the type and location of the alarm.

Figure 3:
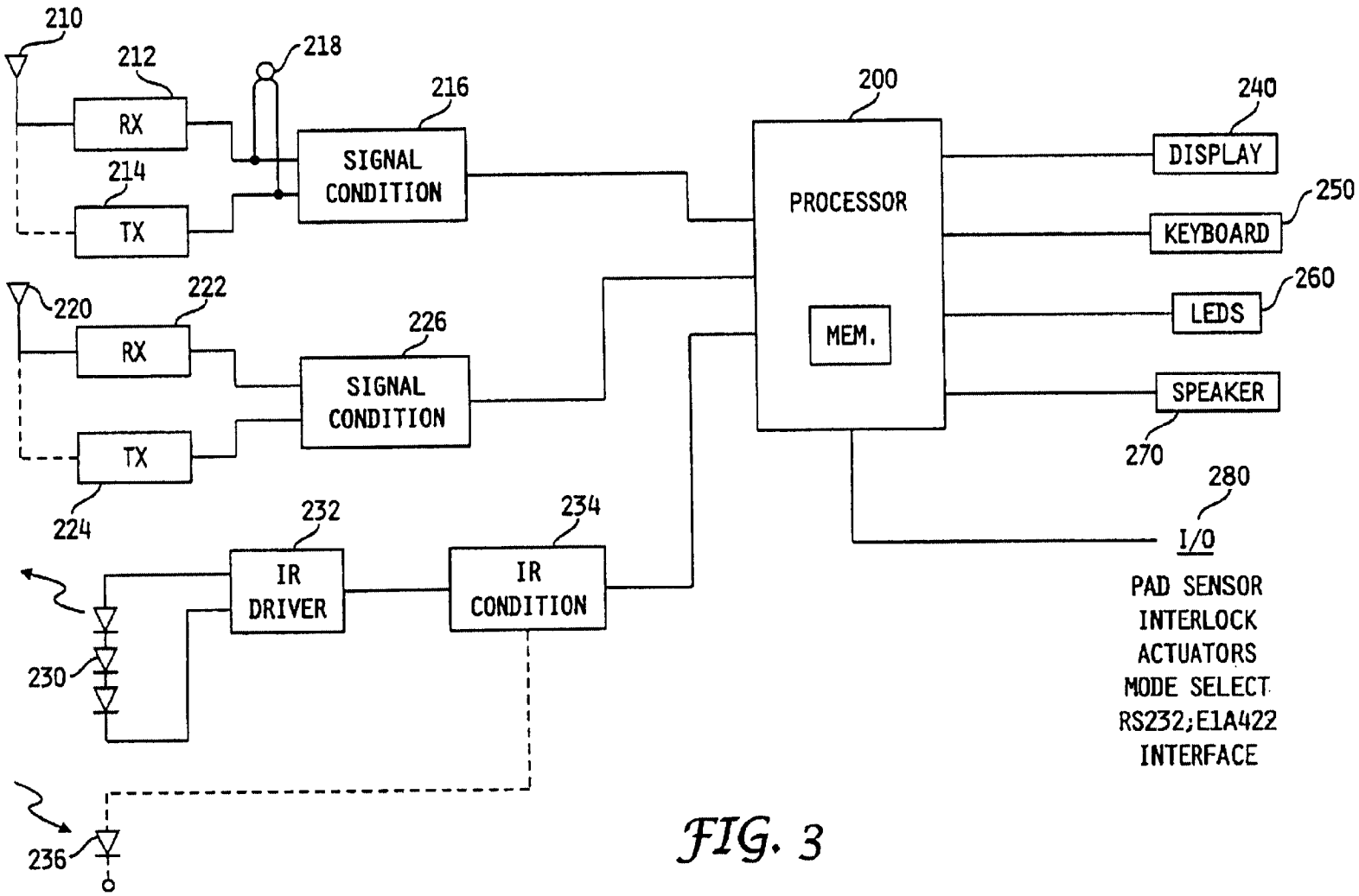
FIG. 3 is a block diagram of components of a transceiver module of the present invention.

FIG. 3 shows a block diagram of the major components of a transceiver modules which can be mounted on the bassinet 18 and walls 22. The transceiver module contains an internal battery supply, but also provides a connection for an auxiliary power pack. It further provides input/output connections to optional external devices such as relays, dry contact closure sensing devices, pressure pads and short range antenna.

The second switch, when pressed, transmits a command, turning on piezoelectric buzzers in all associated badges, excluding the infant anklet, for 15 seconds.

The transceiver module preferably includes embedded infrared (IR) transmitter and two embedded RF receiver/transmitter pairs, a processor DSP 200 with sufficient non-volatile memory to accommodate downloadable transmission and reception attributes of operating parameters including storage for badge associations, and firmware for operating and controlling the TM. The DSP processor is controlled with a drop out (filtering) algorithm to minimize false alarms. That is, spurious signals falsely interpreted as transmissions from badges. Additionally, each TM is programmed with a unique ID as a factory setting. The unique ID may be imprinted on a label affixed to the unit. The TM can be energized from four lithium cells, which may provide continuous power to the transceiver when an optional auxiliary power pack attached to the bassinet 14 is not used. The TM includes an I/O connector for I/O functions including: 1) relay closures, 2) provide dry contact closure outputs, 3) provide auxiliary power to the transceiver, 4) provide an external antenna, 5) provide data I/O for connection to a host PC when the transceiver is acting as a server node, and 6) connecting an optional pressure pad, lights, and auxiliary power.

There are two RF transceivers in each TM. One communicates with all badges within its area and the other communicates with all other TMs. The badge transceiver with antenna 210 operates at a frequency of between 300 and 400 Mhz and the TM transceiver with antenna 220 preferably operates above 900 mHz. The badge transceiver 210 is preferably designed such that the transmitter's power and the receiver's sensitivity are sufficient to communicate at a distance of at least 100 feet. Under such circumstances, the transmitted signals would certainly be received by an RF receiver disposed approximately 30 feet from its associated transmitter. Signal conditioners 216 and 226 include wave-shaper and amplifier which amplify the signals received by receivers 212 and 222. The conditions include a plurality of operatinal amplifiers for detecting the energy level of the received signal. The operation amplifiers (not shown) are connected as comparators which are set at different thresholds. The comparators are monitored by the processor 200 for determining the energy level of the signal received. Connector 218 can be used to connect to a secondary antenna and pre-amplifier. The TMs include display 240, LEDs 260, and speaker 270 for audiovisually indicating alarm conditions. I/Os 280 are connectible to a plurality of sensors or actuators. Sensors can be pad sensors placed in bassinets. Actuators can be controls for relays to lock doors if necessary. I/Os 280 can also be interrupts to processor 200 for triggering event or logical processes.

An infrared transmitter with IR LEDs 230 transmits the TM identification data to an infrared receiver (ceiling unit 10 of FIG. 1), IR conditioner 234 receives a serial bit data stream to be transmitted from the processor 200. The modulator 234 generates a carrier signal which is modulated by the serial data. The modulation can be by FM or ASK techniques known in the art. The modulated signal is fed to an LED driver 232 for providing current driving capability to LEDs 230. Descriptions of an FM infrared transmitter/receiver can be found in U.S. Pat. No. 5,366,022 to U. Segov, the disclosure of which is incorporated by reference herein.

According to an alternate embodiment, the TM includes an infrared receiver (not shown) for receiving infrared signals transmitted from adult badges or other TMs.

Infrared receivers are disposed in ceiling units (10 of FIG. 1). The receiver is capable of receiving infrared transmissions from badge units, preferably at a distance of about 30 feet. The ceiling unit infrared receivers are electronically linked to the central server, which serves as the central processor of the system. The central processor receives badge and TM identification data relayed from the ceiling units. The locations of each transmitting badge or TM unit is determined by the central processor. U.S. Pat. No. 5,455,851 describes in detail a location system useable as the locator system described herein. The disclosure of the '851 in its entirety is incorporated by reference herein.

The use of infrared signaling in addition to RF signaling offers several advantages. Infrared signaling with its line of sight transmission path can be reused in each room without interference from other IR sources and thus allowing a backup means of data transfer while providing precise location information. Preferably the IR radiation is low level, non-coherent and totally eye-safe to avoid any eye damage and is in compliance with government regulation. The IR system is preferably a pulse infra-red operating at a selected data rate. The use of a periodic burst mode of transmission is preferred rather than a continuous mode of transmission, reducing the power consumption of the badges while allowing several IR devices to simultaneously transmit within a given area. This reduced power requirement enables the use of rechargeable battery powered transmitter units (badges) having a reasonable operating cycle.

Figure 2B:
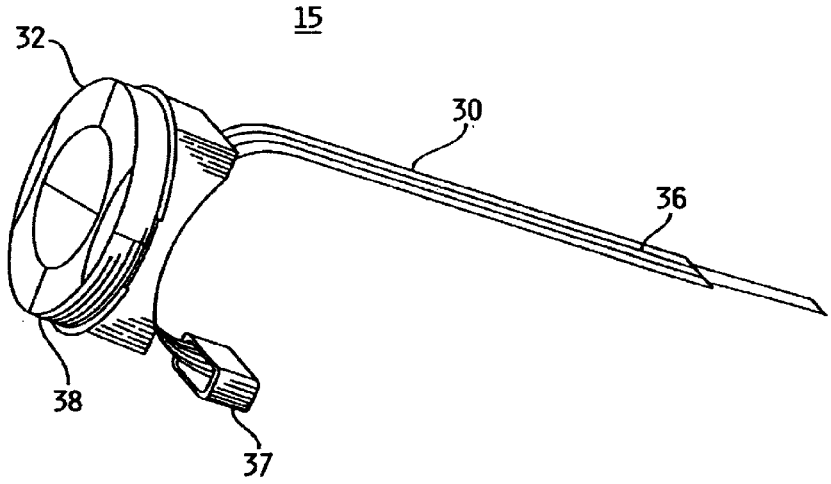
FIG. 2B is a perspective view of an infant badge (anklet).

Referring now to FIG. 2B, the infant badge is a disposable RF transmitter containing a unique ID, implemented at the factory. The badge is both small and lightweight so that it may comfortably wrap around an infant's leg without interfering with the movement of the infant 12. The infant badge somewhat resembles a charm 32 with the RF circuitry encapsulated in a rugged plastic enclosure. The infant badge is preferably hermetically sealed to be able to withstand typical hospital disinfecting procedures. The strap 30 has an embedded antenna 36. Mechanical and electrical interlocks 37 are suited to multiple uses including an ability to tighten the strap as the baby dehydrates after birth. The electrical interlocks detect a loss of continuity. Under normal operating conditions, the badge 15 transmits power with a preferred transmit duty cycle of 0.02% at a 1 second or more rate. The rate of transmission is preferably in the range of 0.5 seconds to several seconds, being set at a manufacturing stage. An alternate embodiment of the infant badge uses an adhesive pad 38. This pad and associated electronics allows for a measurement of skin capacitance. If the badge is removed from the baby's skin an alarm will occur.

Figure 4A:
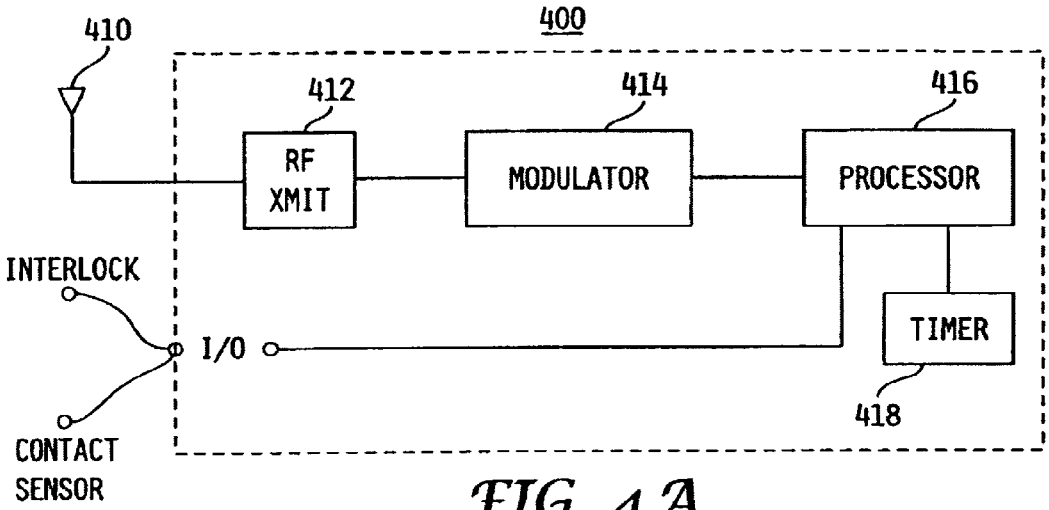
FIG. 4A is a block diagram of major components of an infant badge unit (anklet).

FIG. 4A shows the components of an infant badge 400. The preprogrammed badge 10 is transmitted via RF transmitter 412 via antenna 410. The interlock or contact sensors are connected to I/O port to interrupt processor 416 upon detection of a broken strap or contact.

Figure 4B:
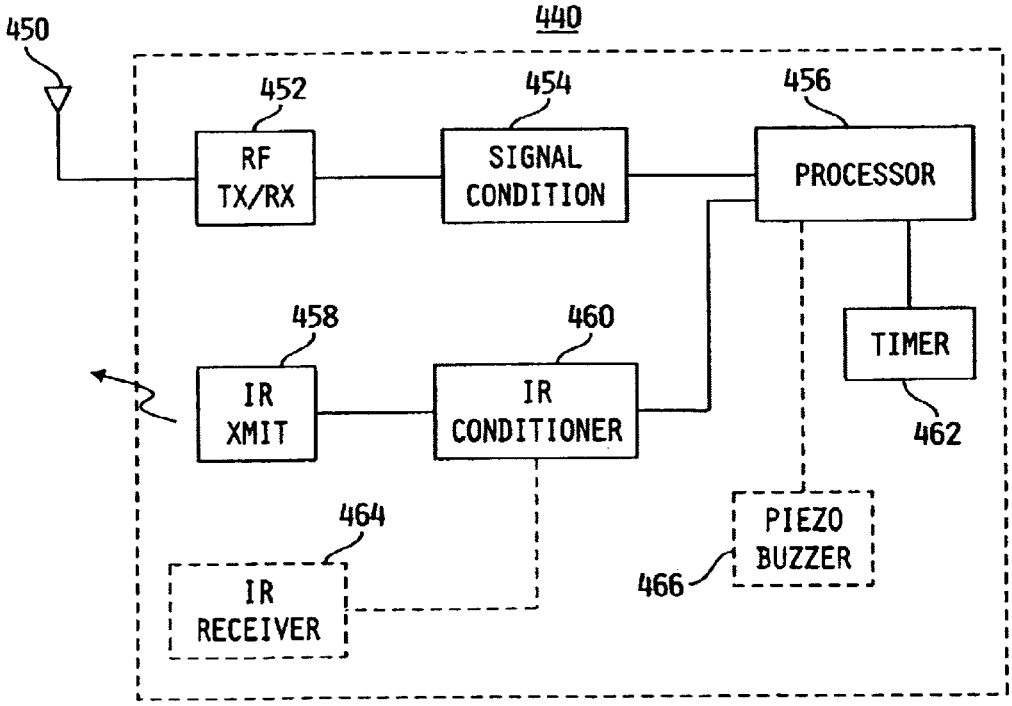
FIG. 4B is a block diagram of major components of adult badge unit.

FIG. 4B illustrates major components of an adult badge 440. The adult badge unit includes an RF transmitter 452 and an infrared transmitter 458. Each badge is preprogrammed with a unique ID as a factor setting for recognition by the TM 18. The badges will preferably transmit RF in the 300 to 400 mHz frequency range. The badges will preferably transmit between 5–15 mwatts at a 0.02% duty cycle. Other embodiments may consider alternate frequency transmission ranges and transmission powers. The infrared (IR) transmitter 458 is used to transmit badge ID data to ceiling unit receivers for location determination. In an alternative embodiment, RF transceiver 452 receives RF signals, including alarm signals from TM 18. A piezo buzzer 466 audibly alerts the badge holder of such alarm. In a further embodiment, IR receiver 464 facilitates receipt of IR signals.

Referring again to FIG. 1, a pressure pad can be placed on a bassinet 14 to detect the lifting of an infant from the bassinet. the pressure pad can be positioned on the underside of the bassinet mattress and connected to the bassinet TM 18 via a connector (not shown). In operation, when an infant 12 is lifted from the bassinet 14, TM 18 senses a relay closure in the pressure pad and switches from a long range antenna mode to a close range antenna mode for a short duration, for about three seconds in a preferred embodiment. In short range antenna mode the TM 18 scans the immediate vicinity surrounding the bassinet 14 to determine the identity of third parties nearest the infant 12. If an associated badge 20 and/or infant badge 15 is detected, no alarm will sound. An alarm will sound, however, if the wrong baby has mistakenly been placed in the bassinet 60 or an associated badge is not present.

A TM and an infant badge form a basic monitoring system, which will provide rudimentary protection by giving an audible alarm at the TM whenever the infant is moved beyond a prescribed safety zone or distance.

Before the core components of a monitoring system are placed at a monitoring location such as at a maternity ward, they must be electronically "associated". That is, when a TM is field deployed it must have some means of recognizing transmissions from badges. That is, the present invention contemplates the simultaneous deployment of similarly situated monitoring systems for monitoring a plurality of infants. As such, the TMs receive transmissions from both the infant and adult badges within its receiving range. It must therefore be capable of distinguishing transmissions received from badges associated with the transceivers and nonassociated badges.

Performing an electronic association for a single hardware set (e.g., associated an infant badge and a plurality of adult badges can preferably be done by placing the TM in close proximity to the badges to be associated and depressing an association button or keypad on the TM, preferably by selecting an 'association' mode from the keypad and display of the TM for a predefined duration of time. The badges transmit their respective IDs and the TM processor places the associated IDs in its memory. Preferably, upon association, the processor the TM displays the associated badges and signals the completion of the association process. Alternatively, badges to be associated are placed inside a Faraday bag (i.e. an electronic signal isolation bag where signals cannot travel beyond the confines of the bag) to perform the "electronic association". The Faraday bag ensures that only those selected components that define a monitoring system for a particular infant (i.e. hardware set) will be "electronically associated".

When a woman checks in to give birth, she is given a RF badge and an ILS badge and the badge information is entered into the control server. The information could be downloaded into MIS or central computer. A bassinet is selected readying for delivery of the baby. The bassinet TM transceiver module can be electronically associated with the mom's badge and her ID. The selected bassinet is moved to the mom's delivery room. Several badges including at least one infant badge should be found or placed in the bassinet, ready for association with the bassinet TM. When baby is delivered, or even prior to delivery of the baby, the infant badge is associated to the bassinet TM by electronic association as previously described. The associated infant badge is attached to the infant. At that time, baby related data such as weight, size or name can be keyed into the bassinet TM. The information can then be uploaded to the wall TM and then central server or computer. Other badges can be associated for family members and visitors to the bassinet TM using the same association process. In the case of multiple births, the associated badges could be copied by all associated data downloaded to a second bassinet TM. A second infant badge is associated with the second bassinet TM. Upon delivery, the infant is placed on the bassinet, no association to wall TMs has yet been performed. When the baby is moved to the nursery, the assigned room is programmed into the bassinet TM or when the bassinet is physically placed in the room, a selection is made on the keyboard to associate that room to the bassinet TM. Once associated, the bassinet TM links with the wall TM which in turn is linked to the central server unit. The infrared locator system (ILS) in the room receives badge transmissions from the bassinet and wall TMs.

The RF system and the ILS system provide two layers of electronic protection. The RF system ("electronic leash")

protects a given range (approximately 15 feet for yellow alarm and 30 feet for red alarm) whereupon if an infant badge is detected to be more than the specified distance, a yellow or red alarm sounds or is displayed. The ILS provides a more precise measure of protection by having the capability to isolate and identify the location of the bassinet TM. Thus, while the RF electronic leash may not be violated, such as when the baby is placed erroneously in an adjacent room, the ILS will detect such error and sounds an alarm.

In an exemplary operation, when the mother is admitted to the hospital, the already associated devices are assigned to the mother. The nurse/care-giver scans a bar code or types in mom's name or other personal identification in the TM. The TM then accompanies mom until delivery, at which point, the associated infant badge is placed on the newborn, the TM is placed either within the bassinet or adjacent to it, and the pressure pad is connected to the TM. The remaining associated guest adult badges are then returned to the nurses station. When visitors arrive they may or may not be required to carry a badge subject to hospital policy. When a bassinet is placed in a nursing room, a wall mounted TM is associated with the bassinet TM. The infant badge periodically transmits the ID to the bassinet TM.

Each associated badge transmits an RF ID that is decoded by the bassinet TM and compared with a pre-stored local 'association' database, and together with the calculated range information, a determination is made as to whether a responsible person (e.g., caregiver, mother, father, visitor) wearing an "associated" badge is within an acceptable range of the infant. The acceptable range is a dynamically programmable value that may change as circumstances require. Such change command may be downloaded from central server to wall TM and to bassinet TM. Note that in the general case, when multiple hardware sets are in simultaneous use, the "association" database serves to discriminate between associated and non-associated RF badge transmissions.

The bassinet and wall TMs communicate via their RF transceivers (at about 900 Mhz). The wall TM is in turn electronically linked to central server via a local area network. Information received by the bassinet TM is communicated to the central server for event and data processing. Location information resident on the central server is typically used for performing event processing. For example, a determination of the badge wearers within a room. Infant, mother and associated data can also be uploaded to the central server in such a way. Alternatively, the wall TM can communicate (via infrared) with the infrared receiver at the ceiling unit, without connecting to a wired network which is in turn electronically linked to a central server. In such mode, all communications are wireless and the expensive 'wired' installations are dispensed.

Alarm Conditions

Alarms are generated under 3 general scenarios: 1) when it is determined that a responsible party is not within a predefined safe distance from an infant, 2) whenever the infant is removed from the bassinet by a non-authorized party, and 3) when the infant is removed from the bassinet by an authorized party beyond a preprogrammed safety zone.

Under the first scenario, the associated badges and infant badge substantially continuously transmit their IDs and range positions to the bassinet TM are determined. The TM is pre-programmed with a safe distance value that determines a maximum allowable separation distance between the infant and at least one responsible party. If the bassinet TM cannot locate at least one responsible party being within a safe distance of the infant an alarm condition occurs. It is important to note that the pre-programmed safe distance value can be changed dynamically, as circumstances require. This feature could prove useful during baby transport between departments to ensure that a responsible party is even closer to the bassinet than would normally be required. All alarm conditions are signalled at the bassinet TM with the appropriate colored LED and/or speaker. The alarm conditions are transmitted to the wall TM which in turn forwards the alarm to the central server via the ceiling unit. According to one embodiment, alarms can only be reset manually at the TM originating the alarm.

Under the second and third scenarios, whenever the infant at issue is removed from the bassinet, the act of removing the infant is detected by the bassinet TM via the pressure pad located beneath the mattress. This action switches the receiving antennas in the TM from a long range high sensitivity antenna to a close-range proximity antenna for a few seconds, on the order of 3 seconds in a preferred embodiment. The range of the close proximity antenna is preferably less than about twelve feet measured from the center of the bassinet. Switching from long to close range antenna mode is intended to identify the badges within close proximity to the bassinet. If the close proximity antenna does not make a proper badge association, a red alarm condition is automatically triggered within the bassinet TM. Detecting an improper association is advantageous for a number of reasons including: 1) if a person is not authorized to pick up the baby, irrespective of whether he or she is wearing a badge, the unauthorized act of removing the baby from the bassinet will automatically sound an alarm at the bassinet TM and also at any central node and secondary transceivers in use, and 2) if a baby is mistakenly placed in the wrong bassinet, the primary transceiver cannot make a proper association thereby causing a read alarm condition.

If, however, the person removing the infant from the bassinet is properly associated (i.e. wearing an electronically associated badge) then under the third scenario, further safeguards are activated whenever that person attempts to stray outside the predefined zone of safety around the bassinet.

The zone of safety can be discussed as two circumferential perimeters centered about the bassinet, a first perimeter defining an inner safety zone, preferably on the order of 15 to 20 feet from the center of the bassinet, and a second perimeter defining an outer safety zone, preferably on the order of 30 feet from the center of the bassinet. If the person holding the infant strays beyond the first perimeter, the bassinet TM will go to yellow alert, illuminate a yellow flashing warning light, warning that person that they are about to exceed the outer safety zone (i.e. second perimeter). If that person does not move back inside the bounds of the first perimeter within some pre-programmed time, preferably around 30 seconds in a preferred embodiment, then the light on the bassinet TM will go to red (i.e. red alarm condition). The bassinet TM sounds an audible alarm and transmits a red alarm condition. Further, whenever the infant is moved beyond the bounds of the second perimeter an immediate red alarm condition is generated at the bassinet TM. In one embodiment, the red-alert alarm condition transmitted from the bassinet TM is received by the RF receiver 464 in the associated adult badges. The red-alert condition is transmitted to the wall TM 22 via the TM to TM RF link and in IR to ceiling unit 10, which in turn relays the alert condition, including the ID of the originating bassinet TM 18 to the locator central server. As previously described, the central server has location information on all badge wearers and thus can alert all appropriate personnel of the hospital including central nurse stations personnel to the infant.

In one embodiment, the wall mounted TM 22 is connected to a computer net work with a LAN. Such wall TM unit is switched or selected to be in central node (CN) mode. Data uploaded from the bassinet TM 18 can in turn be forwarded to a central server of the network and stored in central database. Preferably, the computer network is connected to the infrared locator system (ILS) for exchange of database and location information. The wall TM 22 can also be used to relay infrared data (to ceiling unit 10) if the bassinet TM 18 is not equipped with an IR transmitter.

Figure 5B:
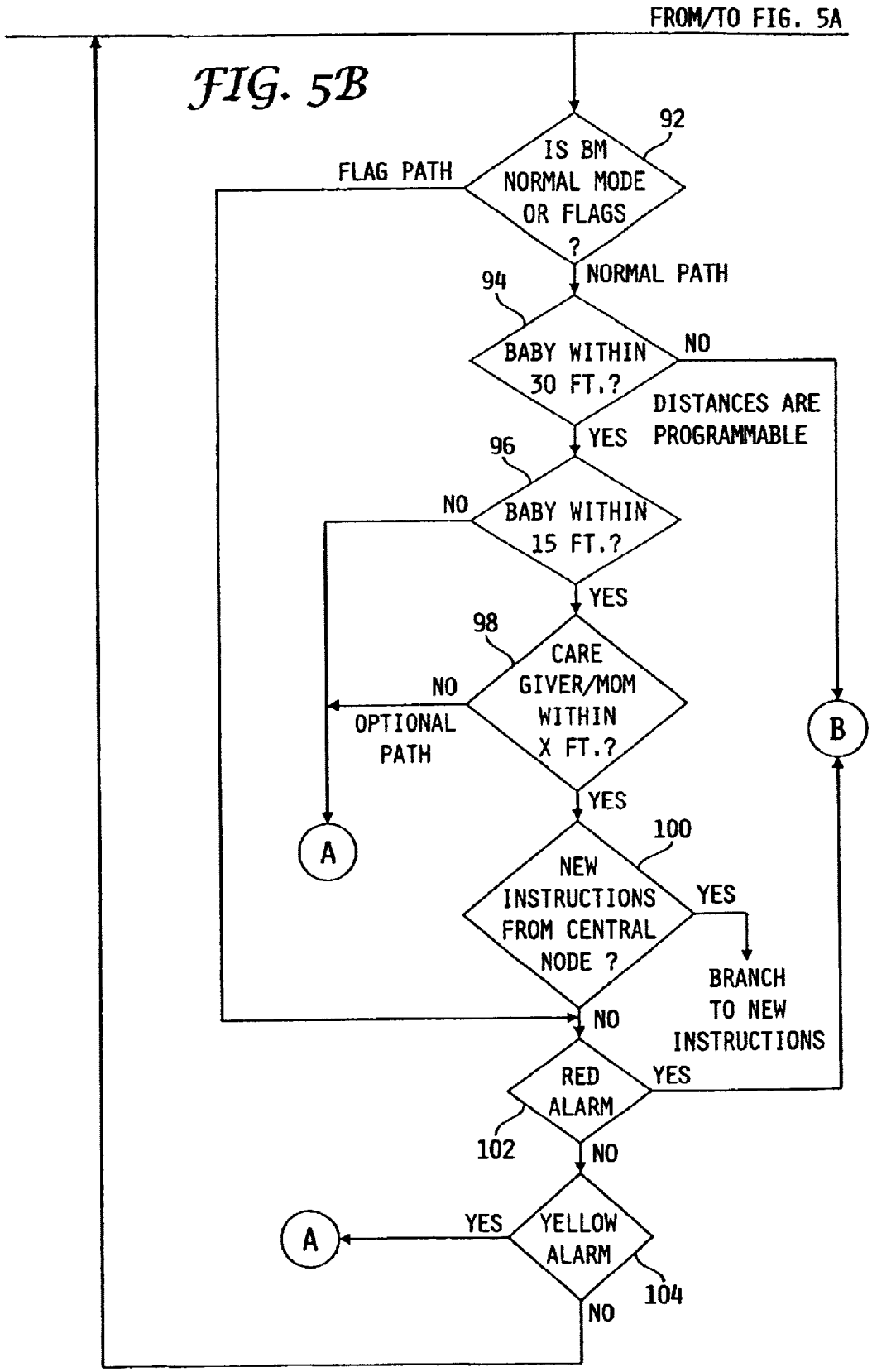

A detailed description of a preferred embodiment of the monitoring and locating system of the present invention will now be given in the context of the flowchart of FIGS. 5A and 5B.

Figure 8:
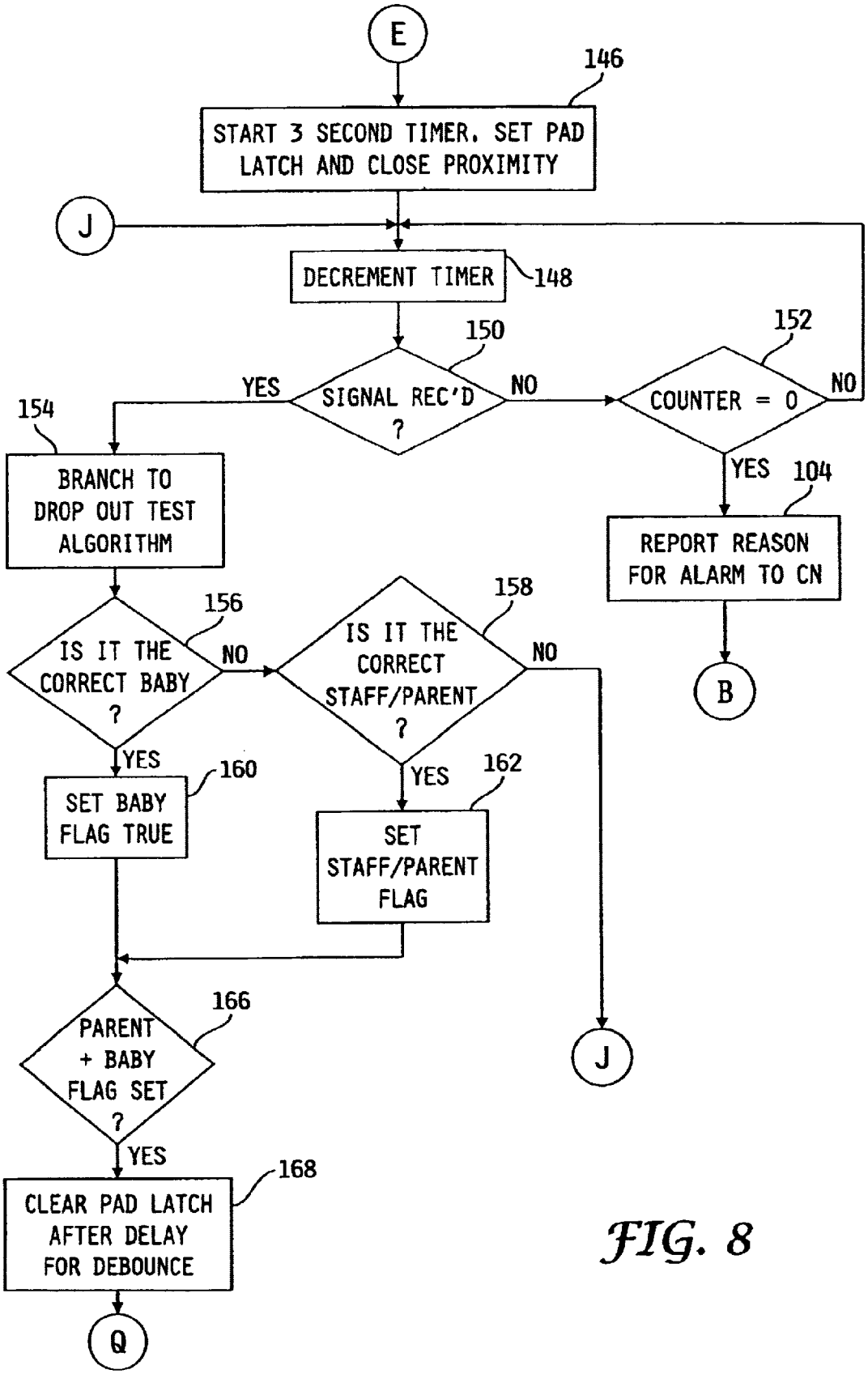
FIG. 8 is a flowchart illustrating a pressure pad processing mode.
Figure 9:
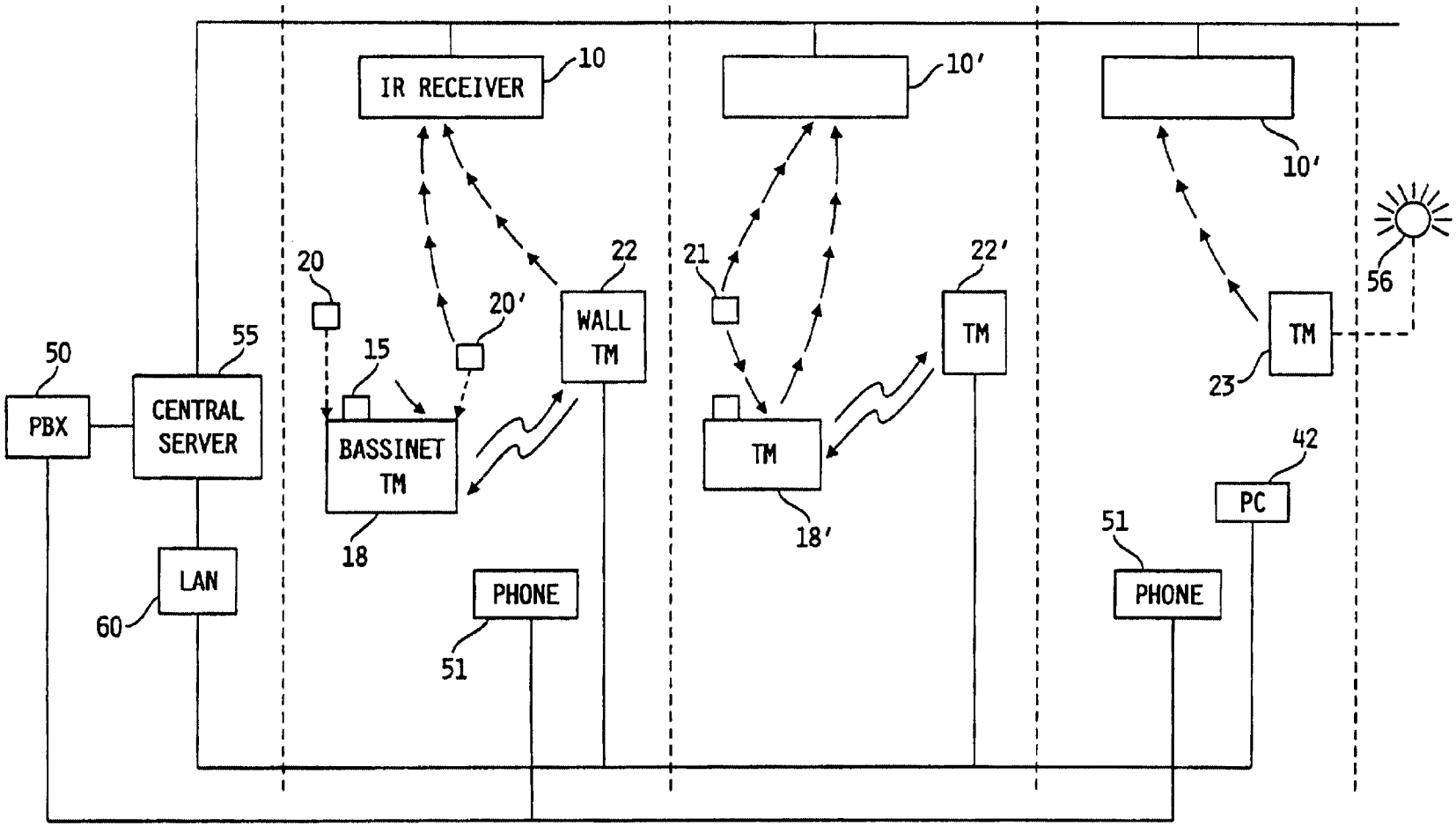
FIG. 9 is an illustration of an overall system according to the present invention.

It should be appreciated that more than one set of associated hardware may be simultaneously utilized within a monitoring environment for the purpose of monitoring a plurality of infants. The following description explains the invention in terms of monitoring a single infant. At step 70, all timers and relays within a module are reset. Step 72 is a determination step to determine whether the transceiver is set to operate in central node (CN) transceiver mode or as a bassinet transceiver. If the switch setting indicates central node transceiver mode then a branch will occur to the CN operation. At step 74 a determination is made concerning the activation of the self test timer flag. If the flag is active the transceiver broadcasts an "I'm OK" signal to any other transceivers within its receiving range (step 76). Next at step 78, the internal timer is reset for some predetermined time interval for a re-transmission of the "'I'm OK'" signal. At step 80, the self test timer is decremented. Step 82 is a determination step to decide whether the association button has been depressed on the transceiver. Depressing the association button associates IDs received by all badges transmitting to the transceiver during the association process (step 83). The associated badge IDs are stored in the association database of the bassinet transceiver module. At Step 84 a determination is made whether a state change has occurred in the pressure pad. If so, the process branches to step 146 (FIG. 8).

At step 146, a 3 second interval timer is started. The bassinet TM will switch from long range antenna mode to short range antenna mode inside this 3 second interval. In addition, the pad latch will be set. At step 148 the timer is decremented by some fixed amount. Step 150 is a decision step to determine whether a close proximity signal has been received by the TM. If not, then the process continues at determination step 152 to determine whether the counter has timed out. If so, a report is forwarded by the bassinet TM to the wall TM acting as a central node transceiver, describing the reason for the alarm condition (step 164). If the counter is determined to be other than zero at step 152, then the process repeats the 148-150-152 loop until either the counter times out or a signal is detected. If a signal is detected at decision step 150, a branch occurs to a filtering algorithm to determine whether the detected signal is a false signal (step 154). If it is determined that the signal is not a false signal, a determination is made whether the infant currently being detected by the close proximity antenna is in fact the infant to be monitored (step 156). Such a determination will be made by the ID transmitted by the infant's badge. This ID is checked against the IDs stored in the association database of the bassinet TM. If it is determined at step 156 that an infant other than the infant to be monitored is detected (i.e. an incorrect infant), the process continues at step 158. Step 158 is a determination step to determine whether the detected signal is associated with a responsible party (i.e. staff, parent, etc. . . . ). If not, then the process returns to decrement the counter at step 148. Otherwise if it is determined at decision step 156 that the correct infant has been detected then the process continues at step 160 where an infant flag is set true. Otherwise if it is determined at decision step 158 that a responsible party was detected then a staff/parent flag/is set true at step 162. From either step 160 or 162, the process continues at decision step 166, wherein a determination is made whether both the infant and staff/parent flags have been set. If so, at step 168 the pad latch, which was previously closed to initiate the alarm condition, is now cleared. The process then returns to step 74 (FIG. 5A).

Returning to FIGS. 5A and 5B, when the monitoring system is operating in normal mode, i.e., the bassinet TM has the green LED lit. The processor in bassinet TM continually monitors the infant (steps 92 to 100). Decision step 94 makes a determination as to whether the infant is located within the 30 foot safety zone perimeter of the bassinet. If not alarm mode processing will occur (See steps 128–144). Otherwise, if the baby is within the 30 foot perimeter, it is then determined at step 96 whether the infant is within the 15 foot inner perimeter. If not then the processing steps associated with a yellow alarm mode occur.

Figure 6:
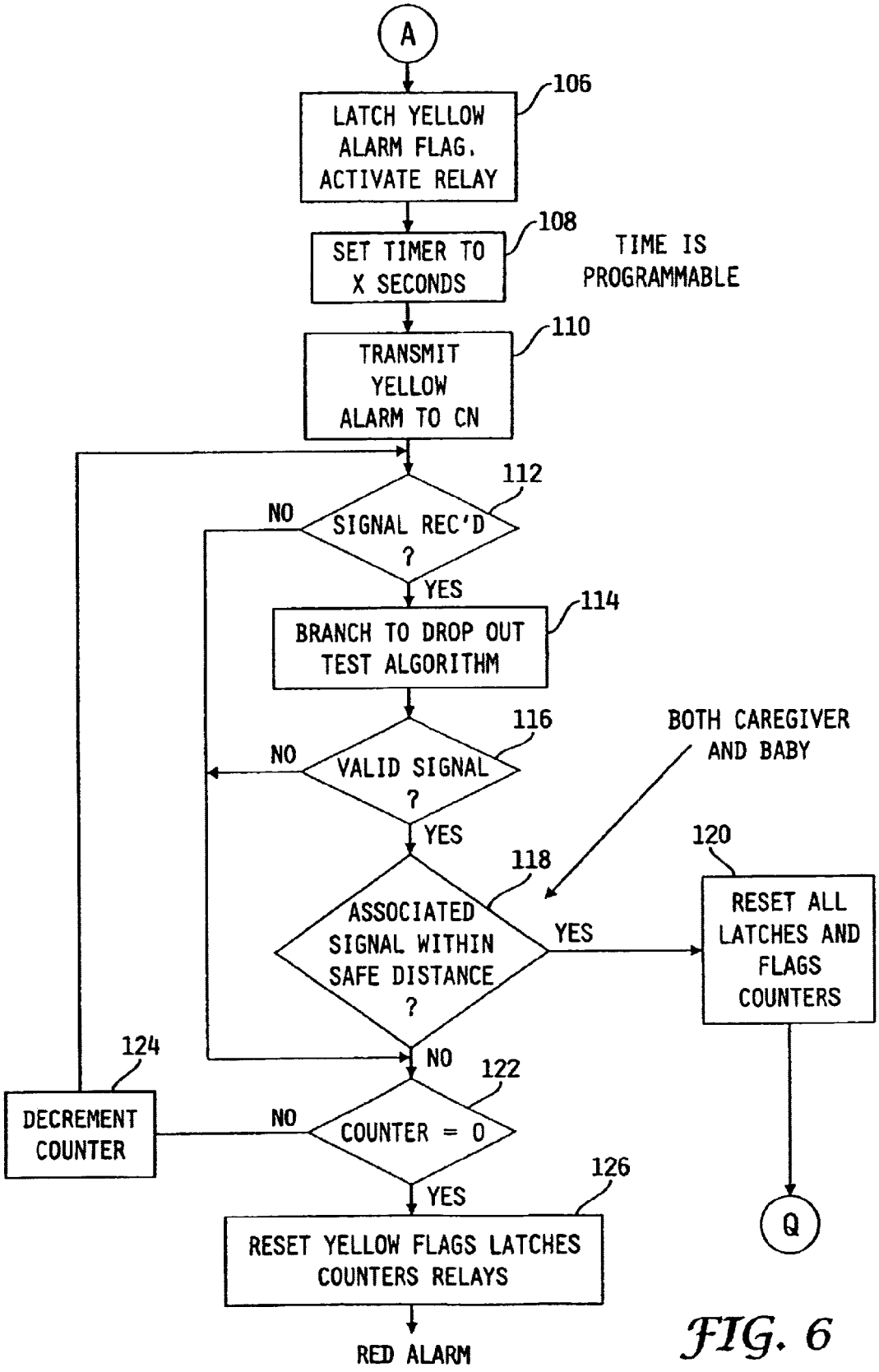
FIG. 6 is a flowchart illustrating a yellow alarm mode.

Referring to FIG. 6, steps 106–126 are the processing steps associated with handling a yellow alarm condition. The 15 yellow alarm mode processing results from decision steps 96, 98, and 104 of FIG. 5. At step 106, the yellow LED on the bassinet TM is lit. Where appropriate, relays controlled by the bassinet or wall TM are activated. At step 108 a timer is set to some predetermined number of seconds within which the infant must be returned inside the bounds of the first perimeter (i.e. safety zone). At step 100, the yellow alarm condition is transmitted to the central node transceiver (wall TM). Step 112 is a determination step to determine whether a valid signal has been received while the timer counts down. If not, the process branches to decision step 132 to determine whether the counter has timed out. If not the counter is decremented at step 124 and the process loops back to decision step 112 to determine if a valid signal has been received. Otherwise, when a signal is received at step 112 a branch occurs to the drop out test algorithm to determine whether the signal is valid. If an invalid signal determination is made the process branches to step 122 to determine it the counter has timed out. If the counter has not timed out the counter is decremented at step 124 and the process returns to step 112. Otherwise if the counter has timed out without a valid signal present (See step 116) the process continues at step 126 where the yellow flags, latches, counters, and relays are all reset. The process then branches to the processing steps associated with the red alarm mode (See steps 128–144). If, on the other hand, a valid signal is determined to be present at step 116 then the process continues at step 118. Step 118 determines whether an associated badge signal is within safe distance. That is, the yellow condition was initially triggered from a negative response at decision step 96. A no response at this step indicates that the baby is outside the inner perimeter. When this situation occurs it must be determined whether a care giver is in close proximity. This determination is made at decision step 118. If a care giver is within close proximity the yellow alarm condition can be reset. This occurs at 10 step 120. The process then returns to step 74 of the main loop.

Figure 7:
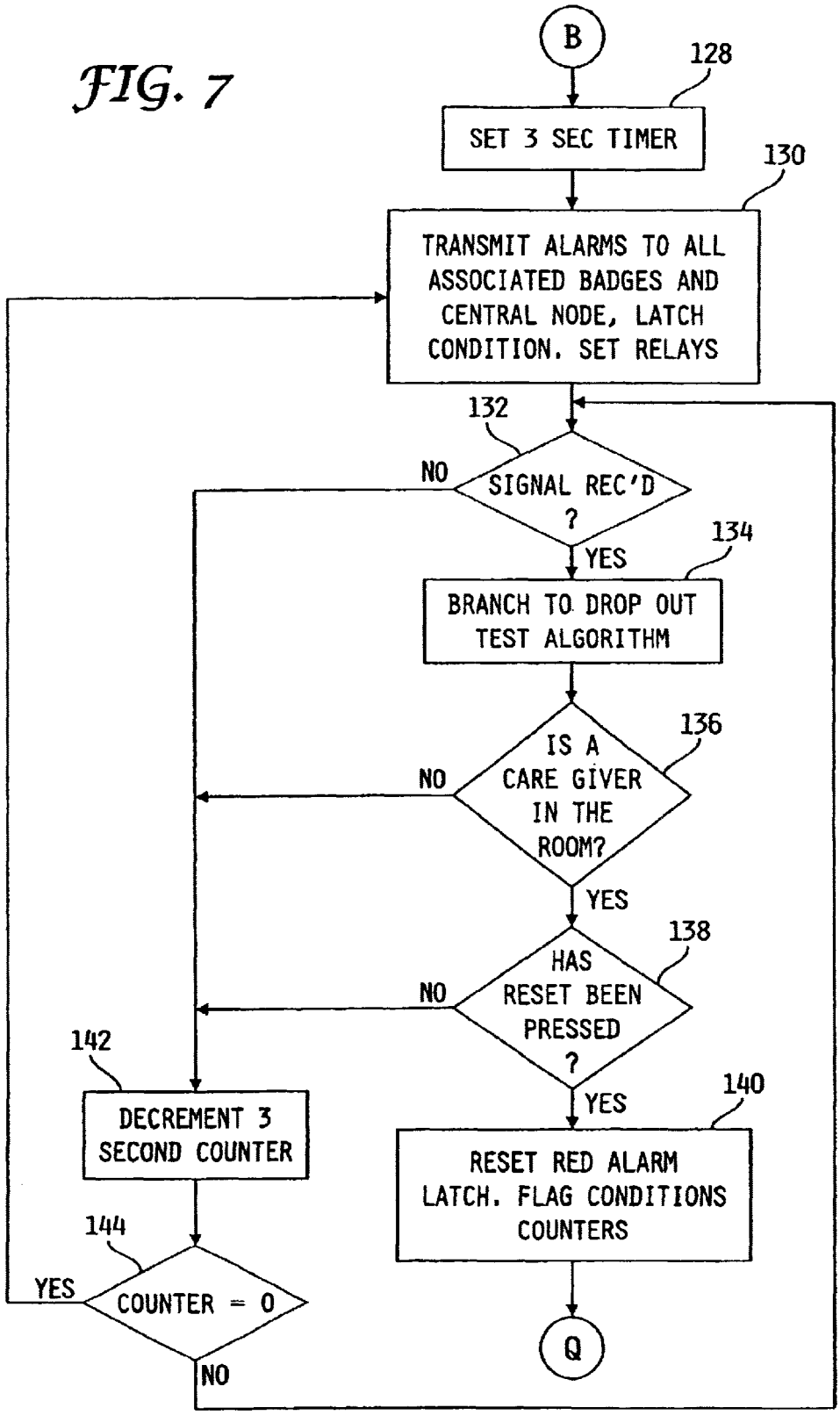
FIG. 7 is a flowchart illustrating a red alarm mode. processing mode.

Referring to FIG. 7, steps 128–144 are the processing steps associated with handling a red alarm condition. At step 128 a 3 second timer is started. Next, at step 130, an alarm broadcast is made to all associated badges and the central node transceiver. At step 132 a determination is made whether a signal has been received by the bassinet TM. If so, a branch occurs at step 134 to the drop out algorithm to determined whether the received signal is a false or a valid signal. If a valid signal is detected the process continues at determination step 136 where a determination is made whether a caregiver is in the room with the infant. If not, then the process branches to step 142 where the 3 second counter is decremented. Next, a determination is made at step 144 whether the counter has timed out. If not the process loops back to step 132. Otherwise, if the counter has timed out with no care giver in the room the process loops back to step 130 where the alarm broadcast will be re-transmitted to all associated badges and the central node transceiver (wall TM). Step 142 checks if it is determined at step 138 that the reset has not been pressed on the primary transceiver. If so, the process continues at step 138. Step 138 is a determination step to determine if the reset has been pressed on the primary transceiver. The process then continues to step 140 where the red alarm latch, flag conditions, and counters are all reset.

Returning to FIGS. 5A nd 5B, step 100 is a decision step to determine whether any new instructions have been received from the central node transceiver (wall TM). if new instructions are received from the central controller via the wall TM, then a branch occurs to respond to the new instructions. If no new instructions have been received the process continues at step 102. Step 102 is a determination step to determine whether a read alarm has been set. If so, the process branches to the steps associated with red alarm mode processing (See steps 128–144, described above). Otherwise, if not red alarm was set the process continues at step 104 where a determination is made concerning whether a yellow alarm has been set. If so, the process branches to the steps associated with yellow alarm mode processing (See steps 106–126, described above). Otherwise the process returns to determination step 74 of the main loop.

Wandering Baby Mode

From time to time it is necessary for an infant in maternity ward to be moved from one room or area of a ward to another. Such movement presents potential problems for a security system. The wandering baby mode addresses the needs of the enhanced security mode required under such a scenario. This mode insures that a responsible person is even closer to the bassinet than would normally be required. In operation, when a bassinet and infant are being transported from point A to point B, a central node transceiver wall TM would pinpoint the bassinet location and then change the sensitivity of the primary transceiver's receiver in response via an RF transmission from the central node transceiver as a function of location. For example, the first perimeter safe distance could be changed from 20 feet to 8 feet +/−3 feet when movement of the infant is contemplated.

Infant Toddler Home Alarm

Another exemplary usage of the system is to provide additional service outside the hospital setting. At discharge time, the infant anklet and the battery module of the badge may be given to the mother as a memento of her stay. The battery module is preferably intended to attach to a key ring (hereinafter referred to as a Key Chain Tag, KCT). The KCT would include the IR/RF transceiver designed to receive alarm commands and transmit ID and key press information, and a piezoelectric beeper for audible alarms. On the rear of the KCT is a bar code containing several hundred bytes of encrypted information about the child. In conjunction with the KCT and infant anklet which are given to the parents at discharge, if a bassinet TM is also given to the parent, it can be attached to a crib or stroller for outdoor use. Pressure pads may also be used with the crib or stroller as previously described. Siblings badges which operate in a similar manner as the infant anklet allow additional sibling to be monitored; and a specialty badge that is designed with moisture detectors that will transmit an alarm if in contact with water (if a pool is nearby). The infant anklet remains a functioning transmitter and the KCT is a functioning transceiver that will continue working for several years. In home operation, if the infant is moved by anyone without the mother's KCT present, an alarm will occur at the KCT. This can provide a deterrent to curious siblings or grandparents who desire to hold the baby but should not. As the infant matures and begins to walk, the same infant anklet, KCT, and primary transceiver can be used to ensure the toddler stays within a certain distance. As the child becomes increasingly independent, the primary transceiver can be placed outdoors to ensure that the toddler stays within an assigned play area. If the child roams outside the assigned play area, the primary transceiver will transmit an alarm to the mother's KCT. As an additional contemplated use, the primary transceiver can be configured to alarm whenever a child enters a restricted area. This allows for very effective coverage when multiple transceiver units are used.

Security and Access Control

Although the primary transceivers primary use is as an infant monitoring device, the units may also be used at remote locations to provide access control or emergency alarms in areas that would otherwise be unprotected. For example, the units could be placed in the hospital parking lot to minimize the threat of attack from strangers. For example, if a person in the parking lot feels threatened, a press of his or her Keychain Tag (KCT) would be received by the nearest transceiver to instantly identify his or her location. The transceiver can be pre-programmed to summon help in those situations.

Other Beneficial Features

A situation may occur involving a lost badge which would Compromise the security of the system. To locate the lost badge, an administrator may program a central node transceiver to transmit a "lock down" mode to all receivers within transmitting range. Immediately, the yellow lamps on each transceiver will flash thereby permitting only a few select people access to the newborns until the lockdown is cleared. Each of the transceivers receiving the instructions may be individually programmed to allow specific persons access and to deny others similar access. As such, a heightened security level is achieved. In addition, because each of the transceivers are remotely programmable, any particular transceiver, or all transceivers may be instructed to look for a match of the missing badge ID and report on the location of the missing badge and enable the audible alarm on that missing badge, thus identifying the location of the lost or stolen device.

FIG. 10 shows the overall connection of the monitoring and location system according to the present invention. A plurality of IR receivers (ceiling units) 10 are connected to central server 55. Each ceiling unit receives IR transmissions from badges and TM units 18, 20, and 22. The received IR information is relayed to central server 55. Based on the information received, central server 55 determines the location of each of all t transmitting badges and TMs by identifying the ceiling unit which forwarded the IDs. Central server 55 processes the information and stores the location information in its associated database. Such information is retrievable by a phone system PBX 50 connected to the central server. Location information can also be retrieved from central server 55 via a local area network (LAN(60, which in turn is connected to a plurality of wall transceiver modules (TM) 22 and PC workstation 42. Within each room, badges 20 communicate with a bassinet TM 18 by RF and communicates with ceiling unit 10 by IR. The bassinet and wall TMs 18, 22 transmit their ID's to ceiling units 10 via IR. The bassinet and wall TM units 18 and 22 communicates with each other in RF. U.S. Pat. No. 5,455,851 describes in detail the communication of location information having a structure similar to the illustrative system of the present invention. The disclosure of '851 patent is incorporated by reference herein.

In operation, infant badge 15 and badge 20 communicate to bassinet TM 18. Badges 20 also communicates their IDs to IR receiver 10. Information received by bassinet TM 18 is communicated to wall TM 22, which can be forwarded to central server 55 through LAN 60. Accordingly, the precise location of each transmitting badge and transceiver module is known at central server 55. Such information is retrievable from any TM 18 or 22 by keypad selection for location information. All information forwarded from bassinet TM 18 can be forwarded to central server 55 via wall TM 22 and LAN 60 including alarm conditions. Upon receipt of such alarm conditions by central server 55, response commands can be issued by central server 55 to all personnel or a nurse station at workstation 42 to take necessary measures. Each of the wall TM 22 and 23 is capable of activating actuators such as nurse follow dome light 56 outside of each room. Triggering of relays to activate locks at entryways by TMs 22, 23 is also contemplated. With the location and association technology employed according to the present invention, each infant, caretaker, and parent location and identity can be dynamically pinpointed and their movement tracked. Further, different alarms can be set and conditions interrogated to appropriately respond according to designed commands.

It should be understood that various changes and modifications to preferred embodiments described herein will be apparent to those skilled in the art without departing from the spirit and the scope of the invention.

What is claimed is:

1. An object monitoring system, including:

a first transmitter for transmitting a first ID; and a portable transceiver module having a receiver for receiving the first ID to electronically associate the first transmitter with the transceiver module by generating a first stored ID in a memory;

wherein the first transmitter remains associated with the transceiver module as the transceiver module is moved from a first position to a second position.

2. An object monitoring system, including:

a first transmitter for transmitting a first ID; and a transceiver module having a receiver for receiving the first ID to electronically associate the first transmitter with the transceiver module by generating a first stored ID in a memory;

wherein the transceiver module indicates an alarm condition by comparing the first ID to the first stored ID.

3. The system of claim 2 wherein the alarm condition occurs when the first ID does not match the first stored ID.

4. The system of claim 2 wherein the transceiver module further includes a processor for comparing the first ID to the first stored ID.

5. An object monitoring system, including:

a first transmitter for transmitting a first ID; and a transceiver module having a receiver for receiving the first ID to electronically associate the first transmitter with the transceiver module by generating a first stored ID in a memory;

wherein the first ID has an associated energy level, the transceiver module indicating an alarm condition by comparing the energy level to a threshold value.

6. The system of claim 5 further including a comparator for comparing the energy level to the threshold value.

7. The system of claim 5 wherein the transceiver module further includes a processor for determining the energy level and evaluating whether the energy level is below the threshold value.

8. An object monitoring system, including:

a first transmitter for transmitting a first ID;

a transceiver module having a receiver for receiving the first ID to electronically associate the first transmitter with the transceiver module by generating a first stored ID in a memory; and a second transmitter for transmitting a second ID, the transceiver module receiver receiving the second ID to electronically associate the second transmitter with the transceiver module and the first transmitter by generating a second stored ID in the memory.

9. The system of claim 8 wherein the second transmitter includes a receiver and an alarm, the transceiver module transmitting an alarm signal to the second transmitter receiver upon failure of a preset condition, the second transmitter responding to the alarm signal by activating the alarm.

10. The system of claim 8 wherein the transceiver module activates an alarm when the first and the second transmitters are separated by more than a preset distance.

11. The system of claim 8 wherein the transceiver module activates an alarm only when both the first and the second transmitters are separated from the transceiver module by more than a preset distance.

12. An object monitoring system, including:

a first transmitter for transmitting a first ID; and a transceiver module having a receiver for receiving the first ID to electronically associate the first transmitter with the transceiver module by generating a first stored ID in a memory;

wherein the transceiver module activates an alarm when the first transmitter is separated from the transceiver module by more than a preset distance.

13. An object monitoring system, including:

a first transmitter for transmitting a first ID;

a transceiver module having a receiver for receiving the first ID to electronically associate the first transmitter with the transceiver module by generating a first stored ID in a memory; and a controller, the transceiver module wirelessly transmitting messages to the controller, the messages including an indication of receipt of the first ID.

14. The system of claim 13 wherein the controller receives messages from a plurality of transceiver modules, the controller determining a location of the transmitter and the locations of the transceiver modules from the messages.

15. The system of claim 14 wherein the controller includes a processor for determining the locations of the transmitter and the transceiver modules.

16. An object monitoring system, including:

a first transmitter for transmitting a first ID;

a transceiver module having a receiver for receiving the first ID to electronically associate the first transmitter with the transceiver module by generating a first stored ID in a memory; and an actuator connected to the transceiver module, the actuator being actuated upon an indication by the transceiver module of an alarm condition.

17. A method of monitoring objects including the steps of:

transmitting a first ID signal from a first transmitter corresponding to a first object;

receiving the first ID signal at a transceiver module;

associating the first transmitter with the transceiver module by storing a first ID corresponding to the first ID signal;

comparing the first ID signal to the first ID to determine whether a preset condition is satisfied; and signaling an alarm when the preset condition is not satisfied.

18. The method of claim 17 further including the step of:

determining an energy level of the first ID signal, the preset condition including a condition wherein the energy level is greater than or equal to a preset energy level.

19. The method of claim 17 further including the steps of:

transmitting a second ID signal from a second transmitter corresponding to a second object;

associating the second transmitter with the first transmitter and the transceiver module by storing a second ID corresponding to the second ID signal; and comparing the second ID signal to the second ID to determine whether the preset condition is satisfied.

20. The method of claim 19 further including the steps of:

receiving at the second transmitter an alarm signal transmitted from the transceiver module when the preset condition is not satisfied; and activating an alarm indicator at the second transmitter upon receipt of the alarm signal.

21. The method of claim 17 wherein the preset condition includes a condition wherein the first transmitter is within the preset distance from the transceiver module.

22. The method of claim 17 further including the steps of:

transmitting messages from the transceiver module to a controller, the messages including an indication of receipt by the transceiver module of the first ID signal; and determining the location of the first transmitter from the messages.

23. An object monitoring system including:

a plurality of transmitters corresponding to objects to be monitored, the transmitters each transmitting a respective, unique ID;

a plurality of transceiver modules, each transceiver module including a receiver for receiving IDs from the transmitters to associate with the transceiver module the transmitters from which IDs are received and to associate the transmitters from which IDs are received with one another by storing IDs corresponding to the received IDs; and a central processing unit for receiving messages from the transceivers including IDs of the transmitters for determining locations of the transmitters.

* * * * *